US005630545A

United States Patent [19]

Jaglowitz

[11] Patent Number: 5,630,545

[45] Date of Patent: May 20, 1997

[54] APPARATUS FOR PACKAGING ARTICLES

[75] Inventor: Joseph J. Jaglowitz, Monett, Mo.

[73] Assignee: Stone Container Corporation, Chicago, Ill.

[21] Appl. No.: 567,674

[22] Filed: Dec. 5, 1995

[51] Int. Cl.[6] ..... B65D 5/32

[52] U.S. Cl. ..... 229/125.19; 229/23 BT; 229/901

[58] Field of Search ..... 229/23 BT, 23 R, 229/125.19, 125.32, 901

[56] References Cited

U.S. PATENT DOCUMENTS

| | | | |
|---|---|---|---|
| 2,316,457 | 4/1943 | Royce | 229/901 |
| 2,579,518 | 12/1951 | Schaefer | 229/125.19 |
| 3,100,075 | 8/1963 | Marshall | 229/23 BT |
| 3,263,895 | 8/1966 | Young | 229/901 |
| 3,543,994 | 12/1970 | Clark | 229/23 BT |
| 4,444,354 | 4/1984 | Staelgraeve | 229/901 |
| 4,474,324 | 10/1984 | Forbes, Jr. | 229/23 BT |
| 4,995,557 | 2/1991 | Fremion | 229/901 |

FOREIGN PATENT DOCUMENTS

| | | | |
|---|---|---|---|
| 2486912 | 1/1982 | France | 229/125.19 |

*Primary Examiner*—Gary E. Elkins
*Attorney, Agent, or Firm*—Dick And Harris

[57] ABSTRACT

An apparatus for the packaging of articles, particularly fragile or other articles which must be hand packed. The apparatus includes an first cover member and a second cover member, each of the first and second cover members being formed from identical blanks which are erected and affixed in a partially raised state. Upon filing of one of the cover members with the articles to be packaged, a remaining side of that member is raised and the other cover member is warped onto the filled member, such that sidewalls of the filled cover member are distorted inwardly, while side corresponding sidewalls of the other cover member are distorted outwardly. A remaining unarticulated wall of sidewall of the other cover member is then folded down into place and affixed.

13 Claims, 3 Drawing Sheets

APPARATUS FOR PACKAGING ARTICLES

BACKGROUND OF THE INVENTION

The present invention relates to apparatus for packaging articles, and in particular to container apparatus for the packaging of fragile or other articles which must be or are preferably hand packed.

A typical prior art container apparatus for the packaging of fragile articles or other articles which preferably must be hand packed, typically comprises a second outer portion and an first inner portion. The second outer portion typically is formed from a rectangular or cruciform blank in which the several sidewalls are successively raised and affixed into place to form a box like configuration, with an open top area. The first inner portion or lid for such a typical prior art container apparatus will be formed from a generally similar rectangular or cruciform blank. However, the blank will typically have a slightly larger area with the scores and cut lines positioned so that once the various sidewalls comprising the first inner portion have been folded and affixed into place, the first inner portion will be telescopingly received over the second outer portion.

Such a prior art container apparatus construction requires that for each particular size or volume container, two differently sized blanks must be purchased in order to form each container.

It would be desirably, therefore, to provide an effective container apparatus for the packaging of fragile articles or other articles which preferably must be hand packed, which would provide a savings in both the costs of materials, and as well the overall time and effort required for the assembly and affixation of the sidewalls, for facilitated assembly of the container apparatus and subsequent packaging of the articles contained therein.

These and other objects of the present invention will become apparent in light of the present specification (including claims), and drawings.

SUMMARY OF THE INVENTION

The present invention is directed to a container apparatus for the retained packaging and enclosure of articles. The container apparatus comprises a first cover member; and a second cover member. The first and second cover members are configured from blanks of container material, which blanks, upon preliminary articulation, form partially erected first and second cover members, respectively, having substantially identical internal and external dimensions. Each of the partially erected first and second cover members has at least one side wall member remaining in an unarticulated state.

At least one of the preliminarily articulated and partially erected first and second cover members is provided with at least one wall member capable of deflection from its partially erected configuration, upon exertion of a deflecting force against at least one wall member. Each one of the preliminarily articulated and partially erected first and second cover members is capable of forced placement over the other one of preliminarily articulated and partially erected first and second cover members, as a result of the deflection, in a cooperative article-enclosing configuration, to collectively form a completely articulated and fully erected container apparatus.

Preferably, the first cover member is formed from a blank which comprises a first wall member having at least a first pair of opposed edge portions and a second pair of opposed edge portions. First and second major sidewall members operably emanate from respective opposed edge portions of one of the first and second pairs of opposed edge portions. First and second minor sidewall member operably emanate from respective opposed edge portions of the other of the first and second pairs of opposed edge portions, preferably in alternating manner with respect to the first and second major sidewall members. Preferably, upon the preliminary articulation of the blank, at least one major sidewall member and at least one minor sidewall member are disposed perpendicular to the first wall member. At least one end flap member operably emanates from one of the first and second major sidewall members and the first and second minor sidewall members and is operably disposed relative thereto, such that upon the preliminary articulation of the blank container material, be at least one end flap member may be articulated so as to extend from the one of the first and second major sidewall members and the first and second minor sidewall members, and overlap at least a portion of another of the first and second minor sidewall members and first and second major sidewall members, respectively, and affixed thereto.

In a preferred embodiment of the invention, the second blank of container material, from which the second cover member is formed, as a configuration which is identical to that of the blank from which the first cover member is formed.

In a preferred embodiment of the invention, on the blank from which the first, inner member is formed, the at least one end flap member comprises two end flap members operably emanating from two of the first and second major sidewall members and the first and second minor sidewall members, and are operably disposed relative thereto, such that upon the preliminary articulation of the blank of container material, the two end flap members may be articulated so as to extend from the two of the first and second major sidewall members and the first and second minor sidewall members, and overlap at least a portion of another two of the first and second minor sidewall members and first and second major sidewall members, respectively and affixed thereto. In a preferred embodiment of the invention, two end flap members are provided on the blank from which the second outer cover member is formed, in a manner substantially identical to the way in which the blank from which the first inner cover member is formed.

Preferably, the at least one remaining unarticulated sidewall member is one of the first and second major sidewall members. Alternatively, the at least one remaining unarticulated sidewall member is one of the first and second minor sidewall members.

In one embodiment of the invention, the major and minor sidewall members are all the same size.

Preferably, the blanks from which the first inner and second outer cover members are formed have identical configurations and sizes.

In a preferred embodiment of the invention, at least one of the blanks from which the first and second cover members are configured is fabricated from at least one of the following materials: cardboard, paperboard, corrugated paperboard.

DETAILED DESCRIPTION OF THE DRAWINGS

Figure 1:
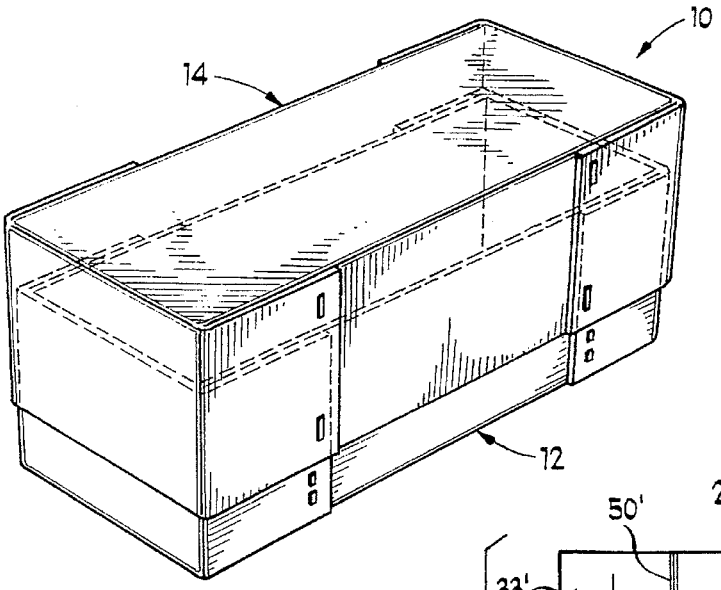
Fig 1 PRIOR ART
FIG. 1 is a perspective illustration of a typical prior art container apparatus, showing the top member being telescopically received over the bottom member.

While this invention is susceptible of embodiment in many different forms, there is shown in the drawings and will be described herein in detail, a specific embodiment, with the understanding that the present invention is to be considered as an exemplification of the principles of the invention, and is not intended to limit the invention to the embodiment illustrated.

Figure 2:
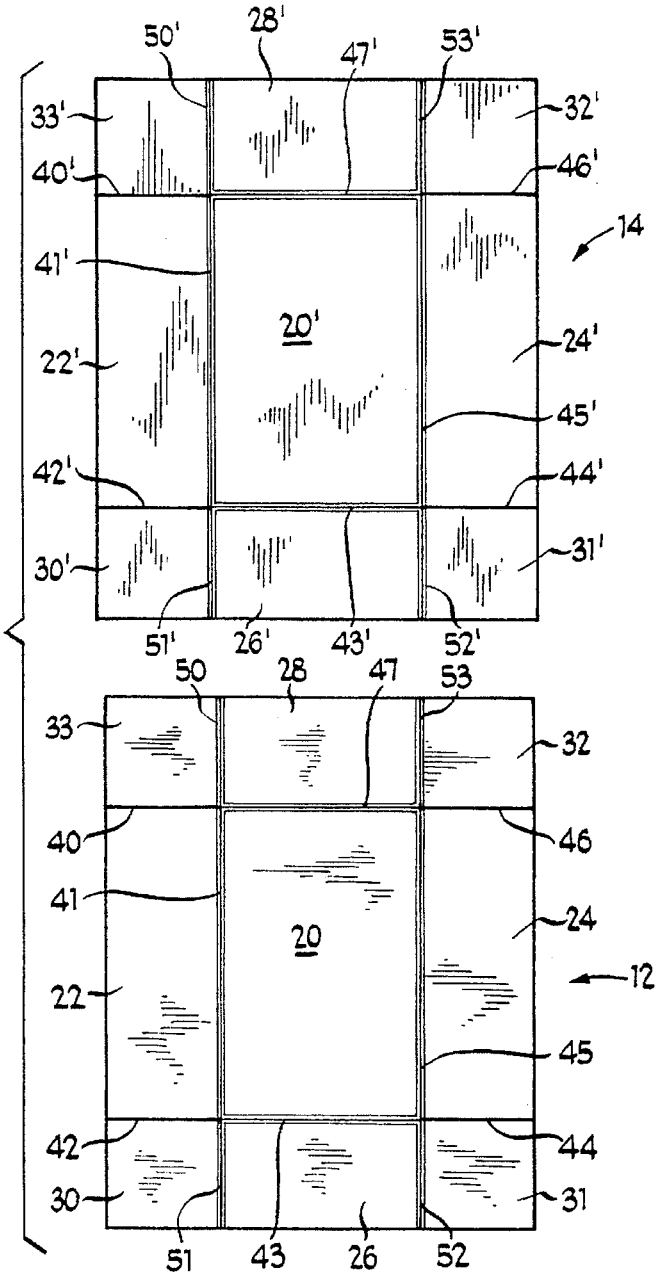
Fig 2 PRIOR ART
FIG. 2 is a plan view of the blanks for the top and bottom members for the prior art container apparatus of FIG. 1.

FIG. 1 and FIG. 2 illustrate a typical prior art container apparatus 10 for the packaging of fragile articles or other articles which preferably are to be hand packaged. Apparatus 10 includes inner cover member 12 and outer cover member 14. Inner cover member 12 may typically be formed as a substantially rectangular blank having a bottom wall 20 two major sidewalls 22 and 24 and two minor sidewalls 26 and 28. In addition, inner cover member 12 also includes end flaps 30–33. Cuts 40–47 may be provided, as well as fold lines 50–53. The configuration illustrated in FIGS. 1 and 2 is typically referred to as "side slotted". Other prior art containers may be "end slotted" wherein the positions of the slots and folds on the end flaps may be transposed. Depending upon various manufacturing factors, both top and bottom may be end slotted, side slotted, or one of each.

Top member 14, while having, typically, a generally similar layout, as bottom member 12, will typically be formed with a larger overall dimension, as well as individually larger areas for each of the major and minor sidewalls and end flaps. Since, as illustrated, top member 14 has a generally similar layout to bottom member 12, the respective sidewalls, fold lines and cuts are indicated, utilizing similar reference numerals with a prime (').

To prepare prior art container apparatus for container articles, typically, the bottom member 12 is prepared first. Minor sidewalls 26 and 28 will typically be folded upright to positions perpendicular to bottom wall 20. Major sidewalls 22 and 24 will then be raised in a similar manner, and end walls 30–33 will then be folded relative to their respective major sidewalls so as to overlap minor sidewalls 26 and 28. The end flaps 30–33 will then be affixed in place, typically utilizing either staples or glue or a combination of both.

Top member 14 will then typically be prepared, in a similar fashion, by folding minor sidewalls 28' and 26' perpendicular relative to top wall 20'. Then major sidewalls 22' and 24' will be folded perpendicular relative to top wall 20' and end flaps 30'–33' will be folded to overlap minor sidewalls 26' and 28' and subsequently affixed in place utilizing staples and or glue as previously described. Bottom member 12 will then be filled with the articles to be packaged, and then top member 14 will be telescopically placed over the packed bottom member 12, as illustrated in FIG. 1.

As can readily be seen from the foregoing, such typical prior art packaging apparatus requires two differently sized blanks for forming the top and bottom members, for each specific nominal size of container. In addition, bottom member 12 must be completely raised prior to any packing which may be done and then the top member must be completely raised to then cover the filled bottom member.

The present invention seeks to improve upon the prior art apparatus by providing both an effective packaging container requiring only a single sized blank for each of the top and bottom members. In addition, as will be described hereinafter, neither the top nor bottom member require complete assembly prior to packing and enclosure of the articles to be contained.

Figure 3:
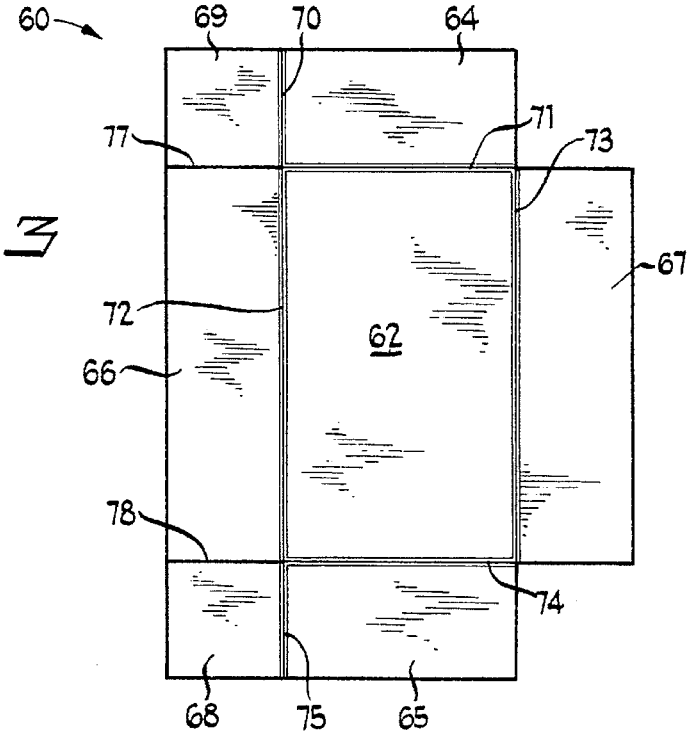
FIG. 3 is a plan view of a blank for the cover members of a container apparatus according to the present invention.

FIG. 3 illustrates a blank such as will be used in accordance with the present invention. A cover member 60, which may be formed from a blank of paper, cardboard, or corrugated paperboard, comprises a top or bottom wall 62, minor sidewalls 64 and 65 major sidewalls 66 and 67 and end flaps 68 and 69 fold lines 70–75 are provided, as well as cuts 77 and 78. The fold lines and cuts may be formed in the conventional manner. In order to provide an apparatus 80 (FIG. 4), a first cover member 60 is formed by folding upwardly minor sidewalls 64 and 65, relative to top/bottom wall 62. End flaps 68 and 69 are then folded perpendicular relative to their respective minor sidewalls 65 and 64, so as to extend parallel fold line 72. Major sidewall 66 is then folded upwardly to be perpendicular relative to wall 62 and affixed to end flaps 69 and 68 by staples and/or glue, such as staples 90. A second cover member 60 is then erected in the identical fashion.

Product is then loaded into one cover member 60, which may be tilted, if practicable, so as to elevate the unfolded major sidewall 67, so that the product will be placed against the erected major sidewall 66.

The second cover member 60 which has been erected is then oriented so that the erected side covers the nonerected or open side of the member which has been filled with product. The sidewalls of the member which has been filled are warped inwardly to fit inside the erected minor sidewalls of the second member. When the second member is pressed downwardly onto the first member the unfolded major sidewall 67 will be warped outwardly, together with the minor sidewalls, to fit over the erected portion of the filled first cover member 60. The flat unfolded major side members 67 of each member 60 will then be protruding horizontally at opposite sides of the container apparatus 80. Major sidewalls 67 will then be folded and forced into a closed position over the erected major sidewalls 66 of the opposite cover members 60. Major sidewall 67 will then be fastened securely with staples, tape, glue, strapping, or any other suitable combination thereof, utilizing known affixation techniques. Alternatively, major sidewalls 67 may be inserted inside major sidewalls 66 as the covers are pressed together. If this is done, major sidewalls 67 need not be fastened with glue, staples, tape, or strapping to maintain an erected state. Such fastening would then be used only to hold the covers together as a means of maintaining closure.

The container apparatus 80 according to the present invention has several advantages over the prior art container apparatus. In particular, the simplicity of providing one size blank to function as both top and bottom members simplifies manufacturing techniques, tooling and overall design cost and cost of manufacture. In addition, as compared to a generally similarly sized blank of a prior art apparatus, less material is required. In addition, since both halves of the container apparatus need only the partially erected prior to filling the filling procedure is simplified and can be accomplished more quickly.

Figure 4:
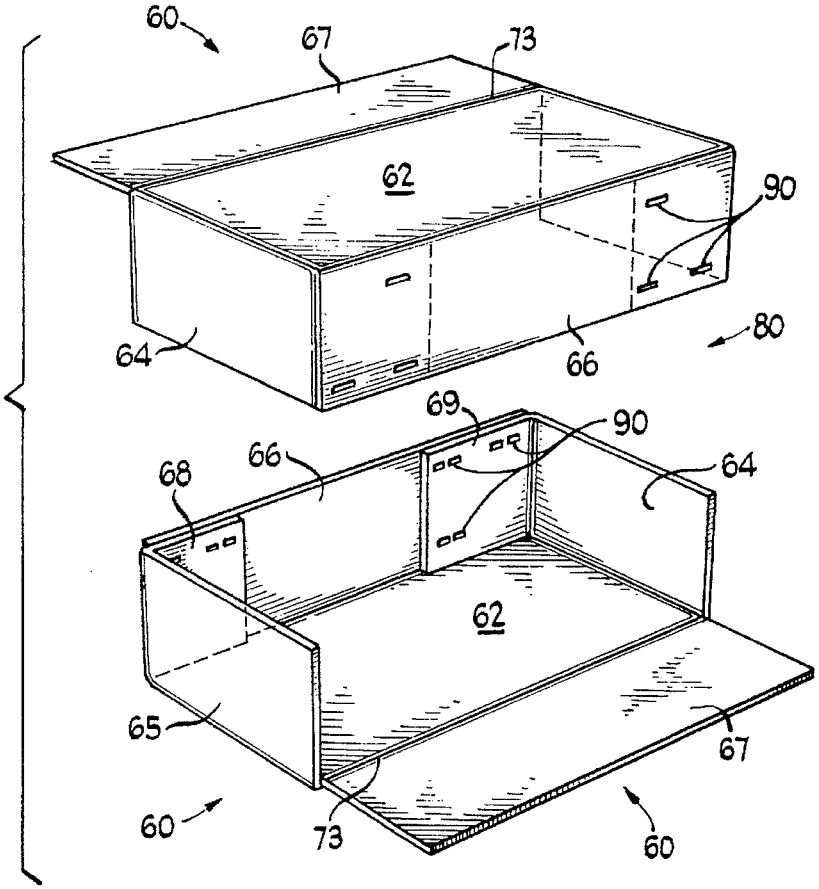
FIG. 4 is a perspective view, of the erected cover members for the container apparatus according to the present invention, showing the cover members in their orientation prior to filling and final closure thereof.
Figure 5:
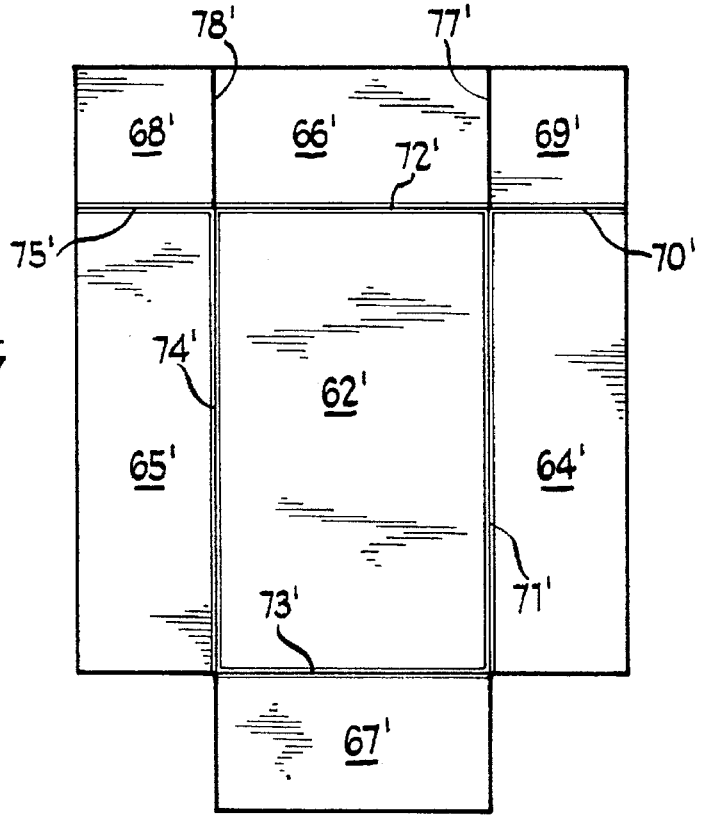
FIG. 5 is a plan view of a blank according to an alternative embodiment of the invention.

FIG. 5 illustrates a blank for an alternative embodiment of the invention, wherein elements which are functionally like to those illustrated and described with respect to the embodiment of FIGS. 3 and 4 are provided with like reference numerals, augmented by a prime (′). In the embodiment of FIG. 5, however, sidewall 67′ is a minor sidewall. The manner of erecting a container apparatus according to the embodiment of FIG. 5 may be readily comprehended as being substantially identical to that of the embodiment of FIGS. 3 and 4.

Figure 6:
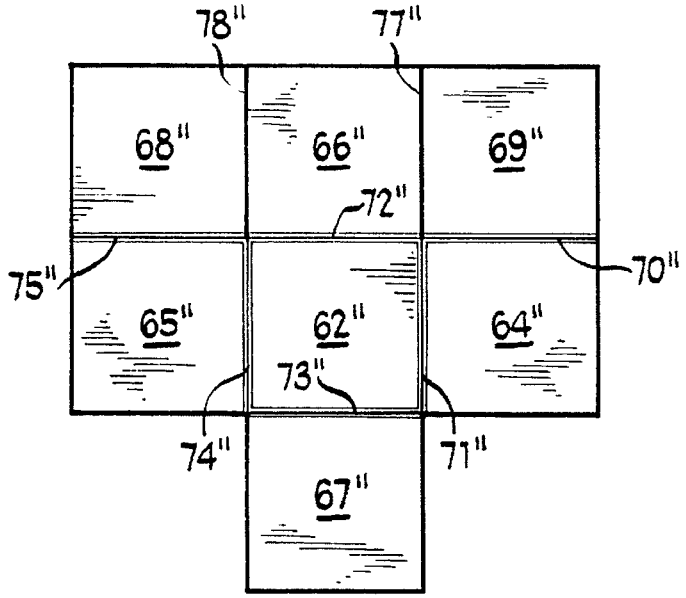
FIG. 6 is a plan view of a blank according to another alternative embodiment of the invention.

FIG. 6 illustrates a blank for an alternative embodiment of the invention, wherein elements which are functionally like to those illustrated and described with respect to the embodiment of FIGS. 3 and 4 are provided with like reference numerals, augmented by a double prime (″). In the embodiment of FIG. 6, however, all of the sidewalls are of the same size. The manner of erecting a container apparatus according to the embodiment of FIG. 6 may be readily comprehended as being substantially identical to that of the embodiment of FIGS. 3 and 4.

The foregoing description and drawings merely explain and illustrate the invention, and the invention is not limited thereto except insofar as the appended claims are so limited as those skilled in the art who have the disclosure before them will be able to make modifications and variations therein without departing from the scope of the invention.

What is claimed is:

1. A container apparatus for the retained packaging and enclosure of articles, comprising:

a first cover member; and a second cover member, said first and second cover members being configured from blanks of container material, which blanks, upon preliminary articulation, form partially erected first and second cover members, respectively, having substantially identical internal and external dimensions, each of the blanks being formed as a plurality of substantially unbroken, unperforated rectangular regions each continguously emanating from at least one adjacent rectangular region, as part of a single, monolithic sheet, each of the partially erected first and second cover members having the same height, each of the partially erected first and second cover members having at least one side wall member remaining in an unarticulated state, connected to the remainder of the blank along a single fold without abutting adjacent flaps, each unarticulated side wall member having a transverse dimension substantially equal to the height of its respective partially erected cover member, at least one of the preliminarily articulated and partially erected first and second cover members being provided with at least one wall member capable of deflection from its partially erected configuration, upon exertion of a deflecting force against at least one wall member, each one of the preliminarily articulated and partially erected first and second cover members being capable of forced placement over the other one of preliminarily articulated and partially erected first and second cover members, as a result of said deflection, in a cooperative article-enclosing configuration.

2. The container apparatus for the packaging of articles, according to claim 1, wherein the blank of container material, from which the first cover member, is formed, comprises:

a first wall member having at least a first pair of opposed edge portions and a second pair of opposed edge portions; first and second major side wall members operably emanating from respective opposed edge portions of one of the first and second pairs of opposed edge portions;

first and second minor side wall members operably emanating from respective opposed edge portions of the other of the first and second pairs of opposed edge portions, in alternating manner with respect to the first and second major side wall members, such that, upon the preliminary articulation of the blank of container material, at least one major side wall member and at least one minor side wall member are disposed perpendicular to the first wall member; and at least one end flap member operably emanating from one of the first and second major side wall members and the first and second minor side wall members, and operably disposed relative thereto, such that upon the preliminary articulation of the blank of container material, the at least one end flap member may be articulated so as to extend from the one of the first and second major side wall members and the first and second minor side wall members, and overlap at least a portion of another of the first and second minor side wall members and first and second major side wall members, respectively, and affixed thereto.

3. The container apparatus for the packaging of articles, according to claim 1, wherein the blank of container material, from which the second cover member, is formed, comprises:

a first wall member having at least a first pair of opposed edge portions and a second pair of opposed edge portions;

first and second major side wall members operably emanating from respective opposed edge portions of one of the first and second pairs of opposed edge portions;

first and second minor side wall members operably emanating from respective opposed edge portions of the other of the first and second pairs of opposed edge portions, in alternating manner with respect to the first and second major side wall members, such that, upon the preliminary articulation of the blank of container material, at least one major side wall member and at least one minor side wall member are disposed perpendicular to the first wall member; and at least one end flap member operably emanating from one of the first and second major side wall members and the first and second minor side wall members, and operably disposed relative thereto, such that upon the preliminary articulation of the blank of container material, the at least one end flap member may be articulated so as to extend from the one of the first and second major side wall members and the first and second minor side wall members, and overlap at least a portion of another of the first and second minor side wall members and first and second major side wall members, respectively, and affixed thereto.

4. The container apparatus for the packaging of articles, according to claim 2, wherein the at least one end flap member comprises two end flap members operably emanating from two of the first and second major side wall members and the first and second minor side wall members, and operably disposed relative thereto, such that upon the preliminary articulation of the blank of container material, the two end flap members may be articulated so as to extend from the two of the first and second major side wall members and the first and second minor side wall members, and overlap at least a portion of another two of the first and second minor side wall members and first and second major side wall members, respectively, and affixed thereto.

5. The container apparatus for the packaging of articles, according to claim 3, wherein the at least one end flap member comprises two end flap members operably emanating from two of the first and second major side wall members and the first and second minor side wall members, and operably disposed relative thereto, such that upon the preliminary articulation of the blank of container material, the two end flap members may be articulated so as to extend from the two of the first and second major side wall members and the first and second minor side wall members, and overlap at least a portion of another two of the first and second minor side wall members and first and second major side wall members, respectively, and affixed thereto.

6. The container apparatus for the packaging of articles, according to claim 2, whereupon the preliminary articulation, the at least one remaining unarticulated side wall member is one of the first and second major side wall members.

7. The container apparatus for the packaging of articles, according to claim 2, whereupon the preliminary articulation, the at least one remaining unarticulated side wall member is one of the first and second minor side wall members.

8. The container apparatus for the packaging of articles, according to claim 3, whereupon the preliminary articulation, the at least one remaining unarticulated side wall member is one of the first and second major side wall members.

9. The container apparatus for the packaging of articles, according to claim 3, whereupon the preliminary articulation, the at least one remaining unarticulated side wall member is one of the first and second minor side wall members.

10. The container apparatus for the packaging of articles, according to claim 2, wherein the major and minor side wall members are the same size.

11. The container apparatus for the packaging of articles, according to claim 3, wherein the major and minor side wall members are the same size.

12. The container apparatus for the packaging of articles, according to claim 1, wherein the blanks from which the first and second cover members are formed have identical configurations and sizes.

13. The container apparatus for the packaging of articles, according to claim 1, wherein at least one of the blanks from which the first and second cover members are configured is fabricated from at least one of the following materials: cardboard, paperboard, corrugated paperboard.

* * * * *